US007821212B2

(12) United States Patent
Wray

(10) Patent No.: US 7,821,212 B2
(45) Date of Patent: Oct. 26, 2010

(54) NETWORKABLE CONTROLLERS FOR LED LIGHTING

(75) Inventor: Donald L. Wray, Ocala, FL (US)

(73) Assignee: J & J Electronics, Inc., Irvine, CA (US)

( * ) Notice: Subject to any disclaimer, the term of this patent is extended or adjusted under 35 U.S.C. 154(b) by 69 days.

(21) Appl. No.: 11/403,567

(22) Filed: Apr. 12, 2006

(65) Prior Publication Data

US 2006/0244622 A1 Nov. 2, 2006

Related U.S. Application Data

(60) Provisional application No. 60/670,727, filed on Apr. 12, 2005.

(51) Int. Cl.
*H05B 37/00* (2006.01)

(52) U.S. Cl. ..... 315/312; 315/291; 362/104; 362/800; 362/811

(58) Field of Classification Search ..... 315/312, 315/149, 210, 291, 294, 362, 185; 362/103, 362/104, 105, 106, 108, 800, 806, 811, 227, 362/228, 231
See application file for complete search history.

(56) References Cited

U.S. PATENT DOCUMENTS

| | | | | |
|---|---|---|---|---|
| 4,514,789 | A | 4/1985 | Jester | |
| 4,824,201 | A | 4/1989 | Kazovsky | |
| 5,519,430 | A | 5/1996 | De Cock | |
| 5,661,374 | A | 8/1997 | Cassidy | |
| 6,072,280 | A * | 6/2000 | Allen | 315/185 S |
| 6,113,248 | A | 9/2000 | Mistopoulos | |
| 6,261,119 | B1 | 7/2001 | Green | |
| 6,362,578 | B1 | 3/2002 | Swanson | |
| D474,849 | S | 5/2003 | Lodhie | |
| 6,673,293 | B1 | 1/2004 | Mistopoulos | |
| 6,700,502 | B1 | 3/2004 | Pederson | |
| D496,122 | S | 9/2004 | Kan | |
| 6,836,081 | B2 | 12/2004 | Swanson | |
| 6,846,094 | B2 | 1/2005 | Luk | |
| 6,885,035 | B2 | 4/2005 | Bhat | |
| 6,888,383 | B1 | 5/2005 | Fairbanks | |
| 7,038,593 | B2 | 5/2006 | Pederson | |
| 7,095,334 | B2 | 8/2006 | Pederson | |
| 7,114,841 | B2 | 10/2006 | Aanegola | |
| D532,143 | S | 11/2006 | Woertler | |
| D532,544 | S | 11/2006 | Woertler | |
| D541,450 | S | 4/2007 | Cheng | |
| 7,210,818 | B2 | 5/2007 | Luk | |

(Continued)

*Primary Examiner*—Douglas W Owens
*Assistant Examiner*—Jae K Kim
(74) *Attorney, Agent, or Firm*—Robert D. Buyan; Stout, Uxa, Buyan & Mullins

(57) ABSTRACT

LED controller devices (e.g., color changing modules) that may be connected to an LED fixture (e.g., an LED light strip or series of LED light strips) having multicolored LED lights or LED's which otherwise vary in intensity, color, brightness, etc. In some embodiments, the LED light strips may incorporate red/green/blue (RGB) LEDs or white/warm white/amber (WWA) LEDs. This LED controller device operates to vary the colors emitted by the LED lights in accordance with desired programs, colors, tones, light shows, etc. The controller devices of this invention may be used in a stand alone LED lighting fixture of part of a network, such as a network that uses a form of RS-485 architecture known as a "Digital Multiplexed Interface" (DMX) as frequently used for control of lighting.

9 Claims, 4 Drawing Sheets

U.S. PATENT DOCUMENTS

| | | | | |
|---|---|---|---|---|
| 7,250,872 | B2 | 7/2007 | Klinger | |
| 2003/0058450 | A1* | 3/2003 | Mosley et al. | 356/436 |
| 2004/0037080 | A1 | 2/2004 | Luk | |
| 2005/0047134 | A1* | 3/2005 | Mueller et al. | 362/231 |
| 2005/0156496 | A1* | 7/2005 | Takashima et al. | 313/237 |
| 2005/0270774 | A1 | 12/2005 | Pan | |
| 2006/0202850 | A1 | 9/2006 | Hefreight | |
| 2008/0088254 | A1 | 4/2008 | Yang | |

* cited by examiner

NETWORKABLE CONTROLLERS FOR LED LIGHTING

RELATED APPLICATION

This patent application claims priority to U.S. Provisional Patent Application No. 60/670,727 entitled "Networkable Controllers for LED Lighting" filed on Apr. 12, 2005, the entire disclosure of which is expressly incorporated herein by reference.

FIELD OF THE INVENTION

The present invention relates generally to lighting systems and methods and more particularly to light emitting diodes (LED) systems and controller devices for controlling the light emitted by the LEDs by analog means.

BACKGROUND

Lighting systems based on light emitting diodes (LEDs) have become available for a variety of applications. In general, LEDs have longer lives than typical light bulbs, are capable of emitting different colors (e.g., red-green-blue LEDs), are smaller in physical form, operate on low voltage, are durable and allow digital addressing and networking, among other benefits. LEDs are now used in a wide variety of applications including; appliance, automotive, signage, advertising & display, architectural lighting, accent lighting, consumer product, pool & spa and other applications.

LED light strips may be used for various lighting applications, including but not limited to decorative lighting and lighting on stairs, cabinets, in niches and numerous other locations. LED light strips may be rigid (e.g., light bars) or flexible (e.g., light ropes, ribbons or flexible strips). LED light strips can be substantially weatherproof in construction, thereby making them highly desirable for outdoor applications. LED light strips are sometimes used in new construction as well as retrofit or renovation applications. Individual LED light strips may be connected to one another or networked to provide LED lighting systems (e.g., networks) of desired sizes and/or configurations. To facilitate connecting or networking of LED light strips, some LED light strips have side mount power connect terminals that eliminate gaps in LED spacing when a number of LED light stripes are connected to one another. Some LED light strips are designed to be cut to size using standard scissors.

In some applications, one or more LED light strips may be attached to a controller that is programmed to cause the LEDs to display light shows (e.g., causing individual LEDs to change color and/or change intensity and/or go on or off, at different times).

In general, the LEDs used on LED light strips are either monochromatic or multicolored (e.g., red, green, blue (RGB)). Monochromatic LED light strips are typically used for applications such as cove and niche lighting, bottle displays and banding applications and are available in colors such as white, green, aqua, blue, red, orange and amber. Multicolor LED light strips are also often used for cove and niche lighting, bottle displays and banding applications and additionally are used for color washing and other applications wherein color/shade changes or pre-programmed light shows are desired.

There remains a need for the development of new controllers for LED strip lighting.

SUMMARY OF THE INVENTION

LED controller devices (e.g., color changing modules) that may be connected to an LED fixture (e.g., an LED light strip or series of LED light strips) having multicolored LED lights or LED's which otherwise vary in intensity, color, brightness, etc. In some embodiments, the LED light strips may incorporate red/green/blue (RGB) LEDs or white/warm white/amber (WWA) LEDs. This LED controller device operates to vary the colors emitted by the LED lights in accordance with desired programs, colors, tones, light shows, etc. The controller devices of this invention may be used in a stand alone LED lighting fixture of part of a network, such as a network that uses a form of RS-485 architecture known as "Digital Multiplexed Interface" (DMX) as frequently used for control of lighting. The controller devices may comprise i) a housing member (e.g., a strip of flat plastic or the like), ii) a circuit board positioned on, in line with or in the housing member; a first connector for connecting the controller to an LED light strip and iii) a second connector for connecting the controller to a power source or to another LED light strip. The circuit board controls the light emitted by the LEDs on the LED light strip(s) or fixture(s) to which the controller is connected.

In some embodiments, the controller module of the present invention comprises a color wash analog model that modulates multicolor (e.g., RGB) LEDs in a random way by generating 3 ramp generators not in phase at 3 speeds (e.g., skewed speeds) to create random color changing sequences.

In some embodiments, the controller module of the present invention may comprise a microcontroller that generates control signals which provide pre-programmed light shows. In this regard, the present invention also provides a method for synchronizing a plurality of LED light strips or other light emitting units to change light shows in synchrony through interruption of the AC power source (e.g., turning the power on and off) at predetermined intervals.

In some embodiments, the controller module of the present invention may connect to a DMX network via RS-485 interface or other suitable wired or wireless connector, decode the DMX addresses and supply analog signals to drive RGB or WWA type LEDs.

Further aspects and elements of the present invention will become apparent to those of skill in the art after reading and considering the detailed description and examples set forth herebelow.

DETAILED DESCRIPTION

The following detailed description and the drawings to which it refers are provided for the purpose of describing some but not necessarily all possible examples or embodiments of the invention and shall not be construed as limiting the scope of the invention in any way.

Figure 1A:
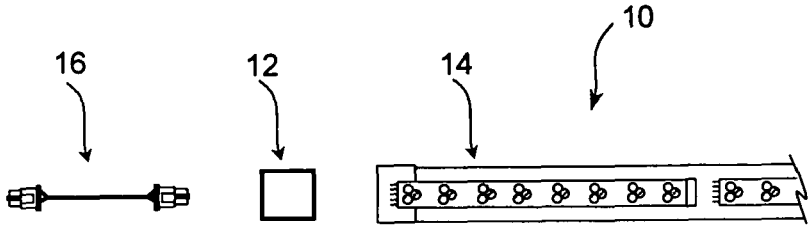
FIG. 1A is an exploded view of one type of LED strip lighting system incorporating an in line controller device of the present invention.
Figure 1B:
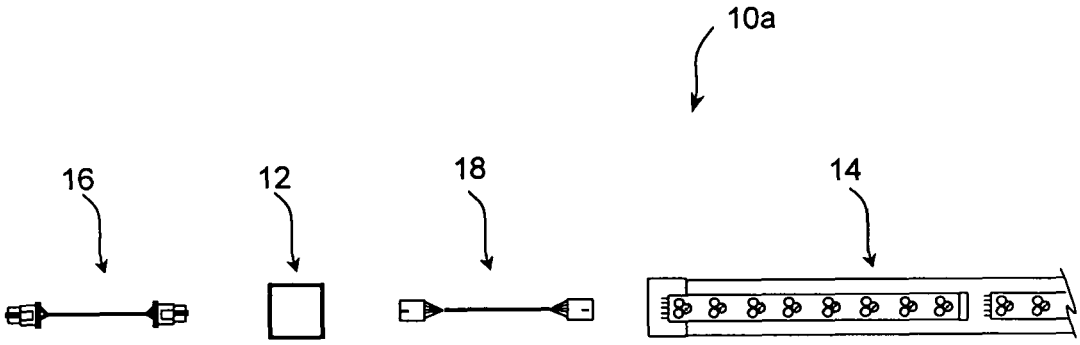
FIG. 1B is an exploded view of another type of LED strip lighting system incorporating an in line controller device of the present invention.
Figure 1C:
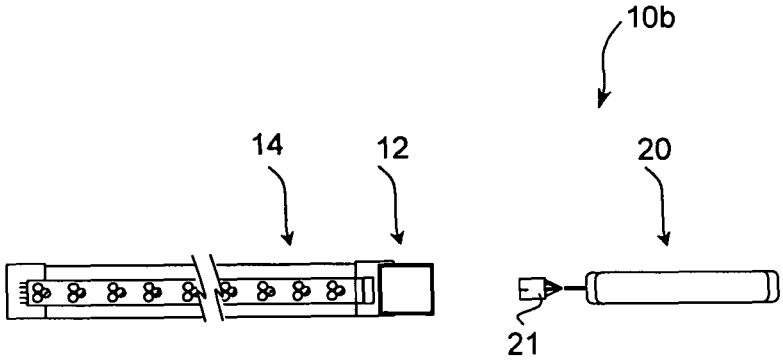
FIG. 1C is an exploded view of yet another type of LED strip lighting system incorporating an in line controller device of the present invention.

FIGS. 1A, 1B and 1C show exploded views of three LED strip lighting systems 10, 10*a*, 10*b* which incorporate the controller device 12 of the present invention.

In the LED strip lighting system 10 if FIG. 1A, a power cord 16 is connected to input power to the controller 12. A single LED light strip 14 or a plurality of LED light strips 14 connected in series (e.g., end to end) are connected to the output of the controller 12, as shown, such that control signals and power from the controller 12 will be received by each of the LED light strip(s) 14.

In the LED strip lighting system 10*a* if FIG. 1B, a power cord 16 is connected to input power to the controller 12. One end of an optional connector cord 18 is connected to the output of the controller 12. The other end of that connector cord 18 is connected to a single LED light strip 14 or to one end of a plurality of serially connected LED light strips 14 such that power and control signals from the controller 12 will pass through connector cord 18 and will be received by each of the LED light strip(s) 14. The use of the optional connector cord 18 is desirable in applications where it is not possible, no feasible or nore desired to connect the controller 12 directly to the LED light strip(s) 14.

In the LED strip lighting system 10*b* if FIG. 1C, remote control unit/power supply unit 16 is connected via a hard wired or wireless connection 21 the input jack of controller 12. The output jack of controller 12 is connected directly (or through an optional connector cord 18 as seen in FIG. 1B) to a single LED light strip 14 or to one end of a plurality of serially connected LED light strips 14 such that power and control signals from the controller 12 will be received by the LED light strip(s) 14. This remote control unit 16 comprises a switch apparatus which may be used to cause the controller 12 to switch from one light mode (e.g., color, color combination, light show, etc.) to another. In some embodiments, the remote control unit may also comprise a power source such that power and switching signals may be input into the controller 12 with the power passing through the controller 12 to the attached LED light strip(s). In other embodiments, a power supply cord may be connected to the other end of the LED light strip(s) 14.

Figure 2:
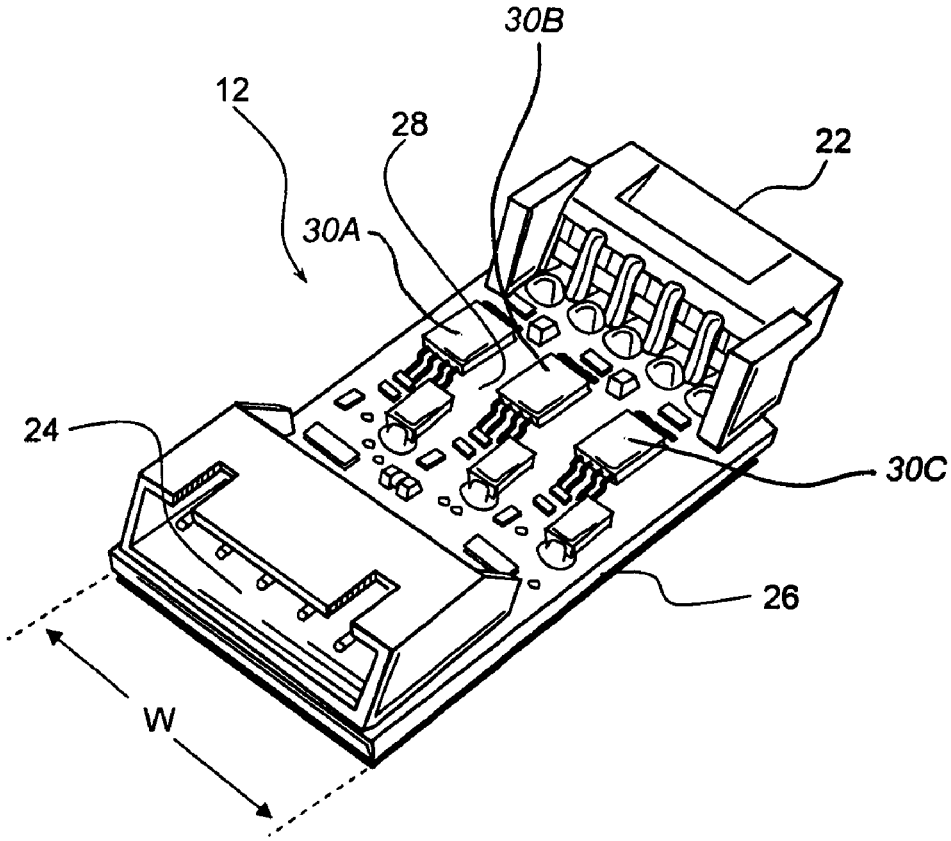
FIG. 2 is a perspective view of one embodiment of a controller device of the present invention.
Figure 3:
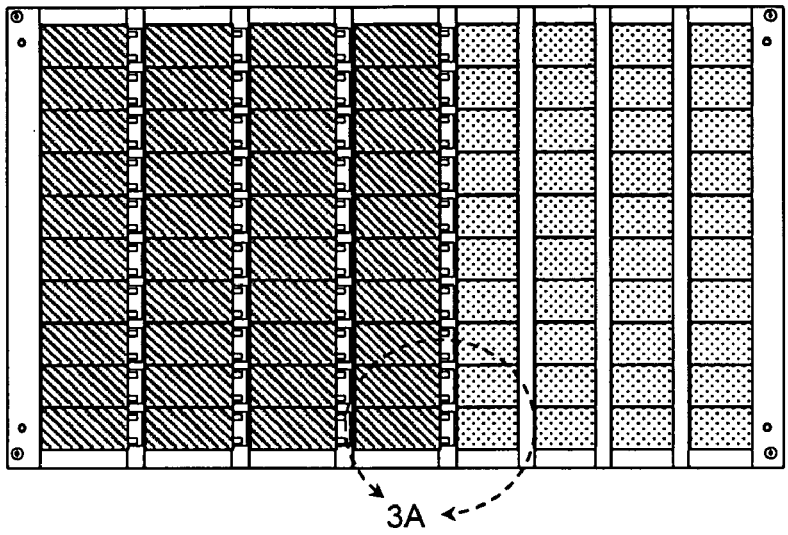
FIG. 3 is a panelized diagram of a printed circuit card that may comprise a component of the controller device of FIG. 2.
Figure 3A:
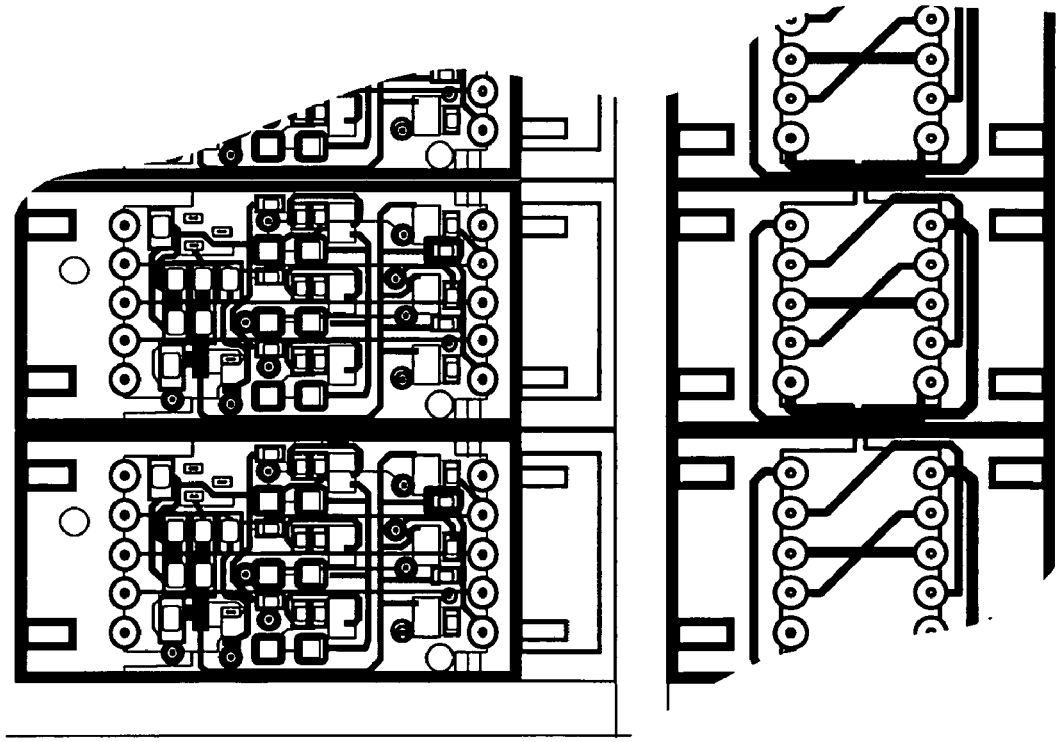
FIG. 3A is an enlarged view of region 3A of FIG. 3.
Figure 4:
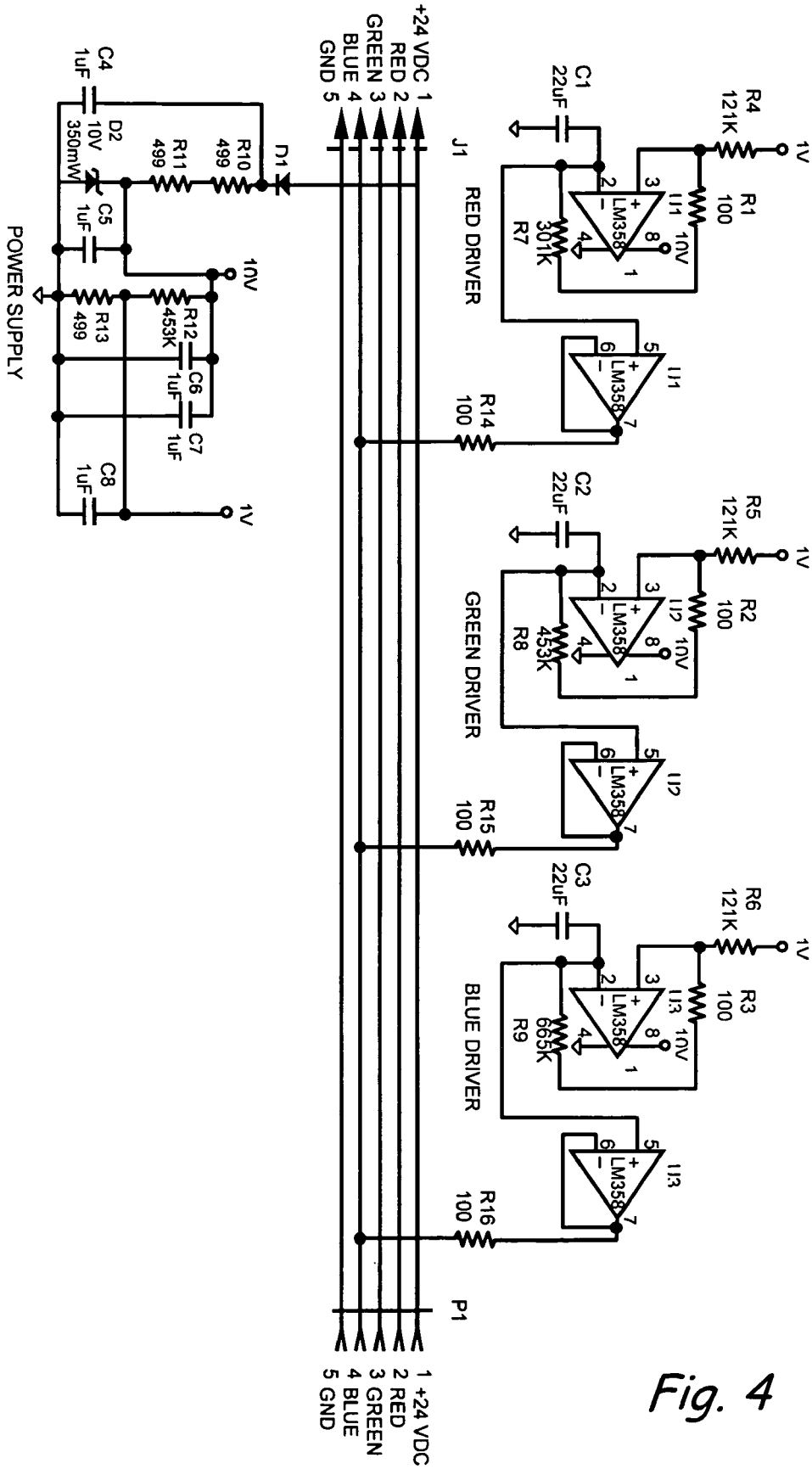
FIG. 4 is electrical schematic of a printed circuit that may be used in the controller device of FIG. 2.

FIGS. 2-4 show one embodiment or example of the manner in which the controller 12 may be constructed and configured. As seen in FIG. 2, this controller 12 generally comprises a substantially flat housing member 26 (e.g., a flat strip of suitable plastic or other material) having a printed circuit board (PCB) 28 mounted thereon and an input connector 24 at one end and an output connector 22 at the other end. The controller 12 may be approximately 1.3 inch long and substantially the same in width W as an LED light strip 14 to which it is to be connected. Connectors 22, 24 may comprise a male connector 22 on one end and a female connector 24 on the other end. These connectors 22, 24 may have the same pin configuration and functions as the LED light strips 14 and/or connector cable 16 and/or controller 20 and/or other component of the LED lighting system to which it is to be connected. This construction allows the controller 12 to be placed in line with the light strip(s) 14 such that it will provide the control function.

Appendix A is a list of examples of component parts that may be used in the in-line strip controller shown in FIG. 2.

With reference to FIG. 3, the PCB 28 (shown on the right) may be used to cross over connector signals such that a zig-zag, serial or "sausage link" configuration of light strips 14 can be connected thus allowing a standard cable to connect one light strip 14 to the next via female/female connectors on a standard cable.

An electrical schematic of the PCB 28 is shown in FIG. 4. This circuit may be of a simple analog color wash design that provides three, out of phase individual ramp generators and drivers to drive the input signal of the light strip(s) 14. In some embodiments, the power range may be a standardized voltage of 0.5V full off to 5 Volts full on, for controlling single transistor current sources in the common emitter configuration used for analog driving of the LED's.

In some embodiments, two of the three oscillators 30*a*, 30*b* may be ⅓ faster than the slower one 30*c*, with the slower one being red, thereby giving the effect of a rhythm wherein the skewed levels go through an infinite number of 3 color combinations to generate all colors possible with an RGB mix. The net effect of this is a smooth analog color wash with no jitters from D/A conversion and post integration creating a very large number of color possibilities. Alternatively, in some embodiments, the controller 12 may comprise a microprocessor controlled digital/analog post integrated analog controller.

Uses for this controller 12 include in line driving of RGB LED light strips 14. Typical applications for this include but are not limited to; edge lighting of glass panels, light bar tops, bottles, under-table coves and other such unique lighting effects. As illustrated in the examples of FIGS. 1A-1C, power is passed through the controller 12 so that the lights strips 14 may receive power as well as the control signals from the controller 12. The controller 12 may be connected to the end of a string (e.g., series) of light strips 14 and, when powered, will control that string of light strips 14 to cause changes in color, and/or on-off and/or variations in intensity of the LED's on the light strips 14 in accordance with the program (s) contained in the controller PCB 28.

The controller 12 may provide flexible and scaleable control to RGB type LED strip lighting systems at a much lower cost then commonly used methods. The controller 12 of the present invention may also provide interchangeable control methods based on a common electrical architecture which lowers cost and complexity to the user.

The present invention also provides modular LED strip lighting systems (e.g., fixtures) wherein the controller 12 functions as the connection point between one or more rigid or flexible light strips 14 or other components of the system rather than being internal to the fixture and/or located at another control point. The fact that the controller 12 of the present invention can physically attach in-line of the power source or be supplied by a remote power source provides for unique flexibility in large networks and makes long power runs more practical because of remote powering. Also the present invention provides low cost solutions in the non DMX control, as there is no housing and controllers are designed to plug inline with our interfaces. Great for use in architectural applications, commercial applications, niche lighting, signage, banding applications, light-washing or wall-washing applications, theme park lighting, restaurant lighting, hotel lobby lighting, casino lighting, lighting or video games, slot machines and the like, nightclub lighting, retail/concession lighting and many other applications.

It is to be appreciated that the invention has been described herein with reference to certain examples or embodiments of the invention but that various additions, deletions, alterations and modifications may be made to those examples and embodiments without departing from the intended spirit and scope of the invention. For example, any element or attribute of one embodiment or example may be incorporated into or used with another embodiment or example, unless to do so would render the embodiment or example unsuitable for its intended use. Also, where steps of a method or process are described in a certain order, the ordering of such steps may be changed unless to do so would render the method or process unsuitable for its intended use. Accordingly, all reasonable additions, deletions, modifications and alterations are to be considered equivalents of the described examples and embodiments and are to be included within the scope of the following claims.

APPENDIX A

CONTROLLER PARTS LIST

| QUAN | REFERENCE | DESCRIPTION | PACKAGE | VENDOR | VENDOR PART NO. | See Note |
|---|---|---|---|---|---|---|
| 1 | N.A. | Custom Printed Circuit Card (Rev 0) | N.A. | J & J | J & J COLOR GLO CONTROLLER1 PCB | 1 |
| 3 | U1, U3 | Dual OP-AMP | 8-TSSOP | TI/Avnet | LM358PWR | |
| 1 | D2 | Zener Diode, 10V | SOT-23 | Diodes Inc | BZX84C10DITR | |
| 1 | D1 | Dual Diode | SOT-23 | Fairchild | MMBD140 | |
| 5 | C4-C8 | .1uF 25V Ceramic Capacitor X5R | 0603 | AVX | 06033D104KAT2A | |
| 3 | C1-C3 | 22uF 10V SMT Tantalum Capacitor | A | Kemet/Generic | T491A226M010AS | |
| 3 | R1-R3 | 100k ohm 1% 1/16W Chip Resistor | 0402 | Generic | | |
| 3 | R4-R6 | 121K ohm 1% 1/16W Chip Resistor | 0402 | Generic | | |
| 1 | R7 | 301K ohm 1% 1/16W Chip Resistor | 0402 | Generic | | |
| 1 | R8 | 453K ohm 1% 1/16W Chip Resistor | 0402 | Generic | | |
| 1 | R9 | 665K ohm 1% 1/16W Chip Resistor | 0402 | Generic | | |
| 3 | R10, R11, R13 | 499 ohm 1% 1/10W Chip Resistor | 0603 | Generic | | |
| 1 | R12 | 4.53K ohm 1% 1/10W Chip Resistor | 0603 | Generic | | |
| 3 | R14-R16 | 100 ohm 1% 1/16W Chip Resistor | 0402 | Generic | | |
| 1 | J1 | 5 Position Male Connector R/A | N.A. | JST | 55B-XH-A-1 | |
| 1 | P1 | 5 Position Female Connector R/A | N.A. | JST | 05JQ-ST | |
| | | To Build Crossover boards add the following components | | | | |
| 2 | (J1-J2) | 5 Position Male Connector R/A | N.A. | JST | 55B-XH-A-1 | 2 |

Notes:
1. Date code MM/YY all finished PCB assemblies.
2, Build Crossover boards except when required, J1, J2

What is claimed is:

1. An LED strip lighting system comprising:

an LED controller comprising a) a housing member; b) a circuit board positioned on, in line with or in the housing member, said circuit board having an integrated circuit that is adapted to drive red, green, blue LEDs, said integrated circuit including first, second and third non-phase-locked, analog oscillators; c) a first connector at a first location; and d) a second connector at a second location;

at least a first LED light strip having red, green, blue LEDs connected to the first connector; and a power source connected to the second connector;

wherein the speed of each oscillator independently causing the oscillators to emit three continuous, out-of-phase, linear ramps which modulate the color and brightness of light emitted by each LED over a continuous, variable range between full on and full off, and wherein the slowest of the three oscillators controls the red LEDs, thereby producing a smooth analog color wash of randomly varying colors formed by the varying combinations of red, green, and blue light emitted from the LEDs, without digital to analog conversion and post integration.

2. A system according to claim 1 having a standardized voltage level that is about 0.5V full off to about 5.0 Volts full on.

3. A system according to claim 1 wherein the oscillation of the first oscillator oscillates at a rate that differs from the rate or rates at which the second and third oscillators oscillate gives rise to skewed voltage levels that cause the LEDs on the first LED light strip to emit light in varied combinations of color.

4. A system according to claim 3 wherein the LEDs comprise red-green-blue LEDs which capable of alternately emit emitting red, green and blue light and wherein the controller causes the light strip to produce different colors of light by causing the red-green-blue LEDs to emit different combinations of red, green and blue light.

5. A system according to claim 4 wherein the first oscillator causes the LEDs to produce red light.

6. A system according to claim 3 wherein the LEDs on the first LED light strip comprise white/warm or white/amber LEDs and wherein the first oscillator causes the LEDs to produce amber light.

7. A system according to claim 1 wherein the controller is of substantially the same width as the first LED light strip to which it is connected.

8. A system according to claim 1 further comprising:

a second LED controller comprising a) a housing member; b) a circuit board positioned on, in line with or in the housing member, said circuit board having an integrated circuit that is adapted to drive multicolored LEDs, said integrated circuit including first, second and third oscillators; c) a first connector at a first location; and d) a second connector at a second location;

a second LED light strip having multicolored LEDs connected to the first connector of the second controller; and the second connector of the second controller being connected to the first LED light strip to receive power from the first LED light strip.

9. A system according to claim 1 wherein the first and second oscillators are faster than the third oscillator, thereby imparting a rhythm effect to light emitted from the light strip.

* * * * *